US011098982B2

(12) United States Patent
Beck

(10) Patent No.: US 11,098,982 B2
(45) Date of Patent: Aug. 24, 2021

(54) INTEGRATED BODY ARMOR HARNESS SYSTEM

(71) Applicant: Tyr Tactical, LLC, Peoria, AZ (US)

(72) Inventor: Jason Beck, Peoria, AZ (US)

(73) Assignee: Tyr Tactical, LLC, Peoria, AZ (US)

( * ) Notice: Subject to any disclaimer, the term of this patent is extended or adjusted under 35 U.S.C. 154(b) by 785 days.

(21) Appl. No.: 15/460,170

(22) Filed: Mar. 15, 2017

(65) Prior Publication Data

US 2018/0266792 A1 Sep. 20, 2018

(51) Int. Cl.
*F41H 1/02* (2006.01)
*A62B 35/00* (2006.01)
*A62B 25/00* (2006.01)

(52) U.S. Cl.
CPC ..... *F41H 1/02* (2013.01); *A62B 35/0031* (2013.01); *A62B 25/00* (2013.01)

(58) Field of Classification Search
CPC ..... A62B 35/00; A62B 35/0018; A62B 1/22; A62B 1/10; B63C 9/115; A41D 1/04; B64D 17/00
USPC ..... 441/115; 182/3, 5; 2/2.5
See application file for complete search history.

(56) References Cited

U.S. PATENT DOCUMENTS 4,378,921 A * 4/1983 Allen ..... B64D 17/30 182/6
4,553,633 A * 11/1985 Armstrong ..... A62B 35/0037 119/857
5,228,412 A * 7/1993 Bell ..... A62B 35/0025 182/3
5,988,315 A * 11/1999 Crane ..... A45F 5/00 182/3
2002/0120973 A1* 9/2002 D'Annunzio ..... F41H 1/02 2/92
2004/0058598 A1* 3/2004 Miller ..... B63C 9/115 441/115
2005/0067221 A1* 3/2005 Wolner ..... A62B 35/0031 182/3
2006/0169534 A1* 8/2006 Green ..... A62B 35/04 182/7
2007/0272484 A1* 11/2007 Helms ..... A62B 35/0018 182/3
2011/0017546 A1* 1/2011 Nichols, Jr. ..... A62B 35/0018 182/3

(Continued)

OTHER PUBLICATIONS

"Integral" Merriam-Webster. Web. https://www.merriam-webster.com/dictionary/integral.*

*Primary Examiner* — Jillian K Pierorazio
(74) *Attorney, Agent, or Firm* — KW Law, LLP

(57) ABSTRACT

Implementations described and claimed herein provide an integrated body armor harness system. In one implementation, a front panel extends between a proximal end and a distal end. A shackle harness is integrated with the front panel, and the shackle harness has at least one shackle strap extending from the front panel and having a shackle loop adapted to receive a shackle for releasably engaging a sling. A leg harness extends from the distal end of the front panel. The leg harness includes a set of leg straps forming a first leg loop and a second leg loop. A back panel is disposed opposite the front panel, with the front panel and the back panel forming a tactical vest. A torso harness is integrated with the back panel, and the torso harness includes a set of shoulder straps.

8 Claims, 12 Drawing Sheets

(56) References Cited

U.S. PATENT DOCUMENTS

| | | | | |
|---|---|---|---|---|
| 2011/0094006 | A1* | 4/2011 | Cole | A45F 5/00 2/102 |
| 2012/0024627 | A1* | 2/2012 | Harshbarger | A62B 35/0006 182/5 |
| 2013/0175117 | A1* | 7/2013 | Schierenbeck | A62B 35/0018 182/3 |
| 2016/0332010 | A1* | 11/2016 | Lowell | A62B 35/0018 |
| 2017/0216635 | A1* | 8/2017 | Stibilj | A62B 35/0025 |
| 2018/0126195 | A1* | 5/2018 | Lopez | A62B 35/0012 |

* cited by examiner

INTEGRATED BODY ARMOR HARNESS SYSTEM

TECHNICAL FIELD

Aspects of the present disclosure relate to systems and methods for protecting the torso of an individual from threats and for extraction of the individual from a tactical environment. More particularly, the present disclosure relates to an integrated body armor harness system that may be converted into a stand-alone extraction harness and/or air crew or pilot specific system.

BACKGROUND

During air missions via helicopter or similar aircraft, such as military, law enforcement, or search and rescue missions, each pilot and air crew member wears an extraction harness. In various mission conditions, the most efficient and sometimes the only way to retrieve an individual quickly is using the extraction harness. For example, a sling load system may be used where an extraction aircraft lowers a sling, such as a rope or cable, with a hook attached to the end. The individual connects the harness to the hook and sits back into the engaged harness for retrieval where the sling is retracted into the aircraft to pull the individual to safety. Such extraction harnesses, however, leave the individual vulnerable to mission specific threats, such as ballistic projectiles, shrapnel from explosions, and/or the like. It is with these observations in mind, among others, that various aspects of the present disclosure were conceived and developed.

SUMMARY

Implementations described and claimed herein address the foregoing problems, among others, by providing an integrated body armor harness system. In one implementation, a front panel extends between a proximal end and a distal end. A shackle harness is integrated with the front panel, and the shackle harness has at least one shackle strap extending from the front panel and having a shackle loop adapted to receive a shackle for releasably engaging a sling. A leg harness extends from the distal end of the front panel. The leg harness includes a set of leg straps forming a first leg loop and a second leg loop. A back panel is disposed opposite the front panel, with the front panel and the back panel forming a tactical vest. A torso harness is integrated with the back panel, and the torso harness includes a set of shoulder straps.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

BRIEF DESCRIPTIONS OF THE DRAWINGS

DETAILED DESCRIPTION

Aspects of the present disclosure involve an integrated body armor harness system including an extraction harness integrated with a tactical vest. In one aspect, the integrated body armor harness system includes a front panel and a back panel connected by a set of cummerbunds to form the tactical vest. In other aspects, the tactical vest may form, without limitation, a plate carrier, a concealable carrier, a low visibility carrier, or other personal body armor used by military, law enforcement, or other personnel to absorb the impact and protect against penetration to the body from a mission specific threat, such as a ballistic projectile and/or shrapnel from explosions.

The integrated body armor harness system further includes an extraction harness having a shackle harness, a leg harness, and a torso harness, which may be an integral system or connected via one or more connection points, such as buckles. In one aspect, the shackle harness is integrated with the front panel of the tactical vest, and the torso harness is integrated with the back panel of the tactical vest. The leg harness extends distally from the tactical vest and includes a set of leg loops for receiving the legs of the individual. The shackle harness extends from the tactical vest and connects to a shackle configured to engage a sling for extraction.

The integrated body armor harness system decreases weight and bulk, which would limit the movement of the individual during critical situations and can make extraction onerous. As such, the integrated body armor harness system provides protection against mission specific threats without inhibiting movement or extraction. Further, the back panel and/or the front panel are removable to convert the integrated body armor harness system into a stand-alone extraction harness. The integrated body armor harness system may be further configured to comport with various shapes and sizes, including, but not limited to female specific, male specific, or neutral systems. Similarly, the integrated body armor harness system may be converted into an air crew system or a pilot specific system. Other advantages of the integrated body armor harness system will be apparent from the present disclosure.

Figure 1:
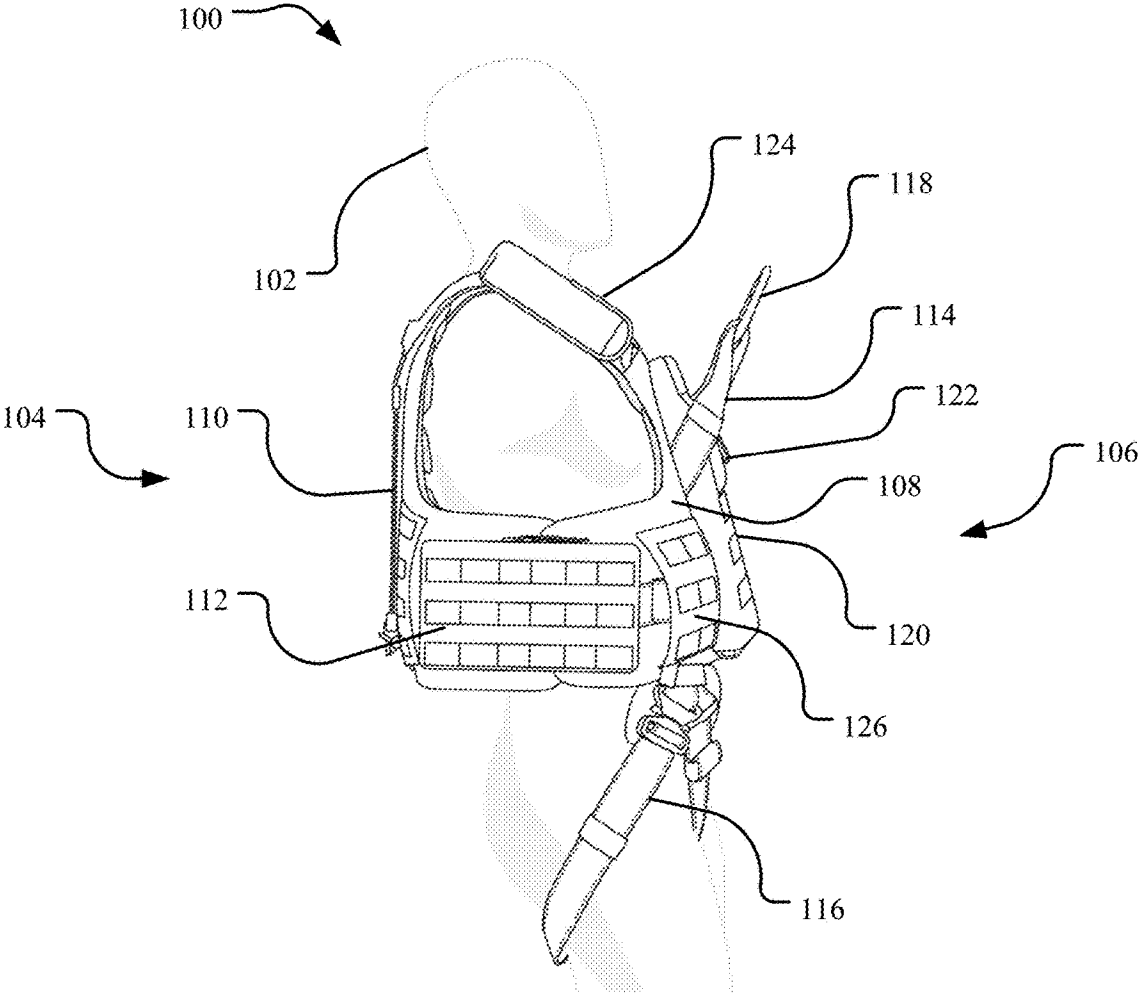
FIG. 1 is a side perspective view of an individual wearing an example integrated body armor harness system prepared for extraction.

To begin a detailed description of an example integrated body armor harness system 100, reference is made to FIG. 1, which shows a side perspective view of an individual 102 wearing the integrated body armor harness system 100 and prepared for extraction. In one implementation, the integrated body armor harness system 100 includes body armor in the form of a tactical vest 104 integrated with an extraction harness 106. It will be appreciated that the tactical vest 104 illustrated in the Figures is exemplary only and the presently disclosed technology may be implemented as a full tactical entry vest, a plate carrier, a low visibility vest, a concealable vest, or the like. Further, the tactical vest 104 may be customized to comport with male anatomy, female anatomy, or be a neutral system.

In one implementation, the tactical vest 104 includes a front panel 108 positioned opposite a back panel 110. A set of cummerbunds 112 may extend between the front panel 108 and the back panel 110. Each of the front panel 108 and the back panel 110 extends between a proximal end and a distal end and a first side and a second side. In one implementation, the sides of the front panel 108 and the back panel 110 are shaped to accommodate the anatomy and movement of the arms of the individual 102, and the proximal end is shaped to accommodate the anatomy and movement of the collar and neck area of the individual 102.

The extraction harness 106 is integrated with the tactical vest 104 permitting the individual 102 to be extracted while providing protection against mission specific threats. In one implementation, the extraction harness 106 includes a shackle harness 114 and a leg harness 116. As can be understood from FIGS. 1 and 2, the leg harness 116 is adapted to receive the legs of the individual 102, and the shackle harness 114 is adapted to receive a shackle 118. The shackle 118 (e.g., a carabineer) is adapted to releasably engage a sling, such as a rope, cable, or the like, for extraction from an aircraft, such as a helicopter. The extraction harness 106 distributes the weight of the individual 102 and provides support, thereby facilitating extraction.

In one implementation, the front panel 108, the back panel 110, and/or the cummerbunds 112 include an interior housing one or more ballistic components for absorbing the impact and protecting against penetration to the body from a threat, such as a ballistic projectile and shrapnel from explosions. Such ballistic components may include, without limitation, a soft body armor, a ballistic hard plate, a ballistic frame, a ballistic plate, a ballistic plate cover, and the like.

For example, a hard plate, such as an Enhanced Small Arms Protective Insert (ESAPI), may be disposed within a front pocket 120 with a stake face oriented away from the wearer and a back face oriented towards the wearer. A ballistic plate cover may wrap around at least a portion of a periphery of the ballistic hard plate to provide additional protection against side spall created by augmentation of the ballistic hard plate. Such a ballistic cover further improves the structure of the front pocket 120 and enhances area coverage and range of motion for increased ergonomics and performance, while providing additional ballistic coverage beyond a front edge of the ballistic hard plate and beyond side edges of the ballistic hard plate.

A soft body armor may be disposed in the front pocket 120 behind the ballistic hard plate on the back face side to provide additional protection and force absorption. A ballistic frame may be disposed within the front carrier pocket 116 behind or in front of the soft body armor. The ballistic frame includes a body configured to improving overall load carriage performance of the front pocket 120 and the tactical vest 104 by providing a rigid platform to add weight. The frame body further reduces fatigue by improving the structure of the tactical vest 104 by retaining the soft body armor in a configuration that prevents bunching and provides support to the ballistic hard plate to improve edge hit protection. The ballistic frame is loose from or otherwise unattached to the soft body armor within the front pocket 120. The ballistic frame absorbs and otherwise dissipates energy from an impact of a projectile against the ballistic hard plate and/or the soft body armor. It will be appreciated that such ballistic components are exemplary only and that other protective devices may be included in addition or as an alternative to these protective devices. Further, one or more of such ballistic components may be included elsewhere in the tactical vest 104 other than the front pocket 120, such as in a back pocket, the cummerbunds 112, and/or the like.

Figure 2:
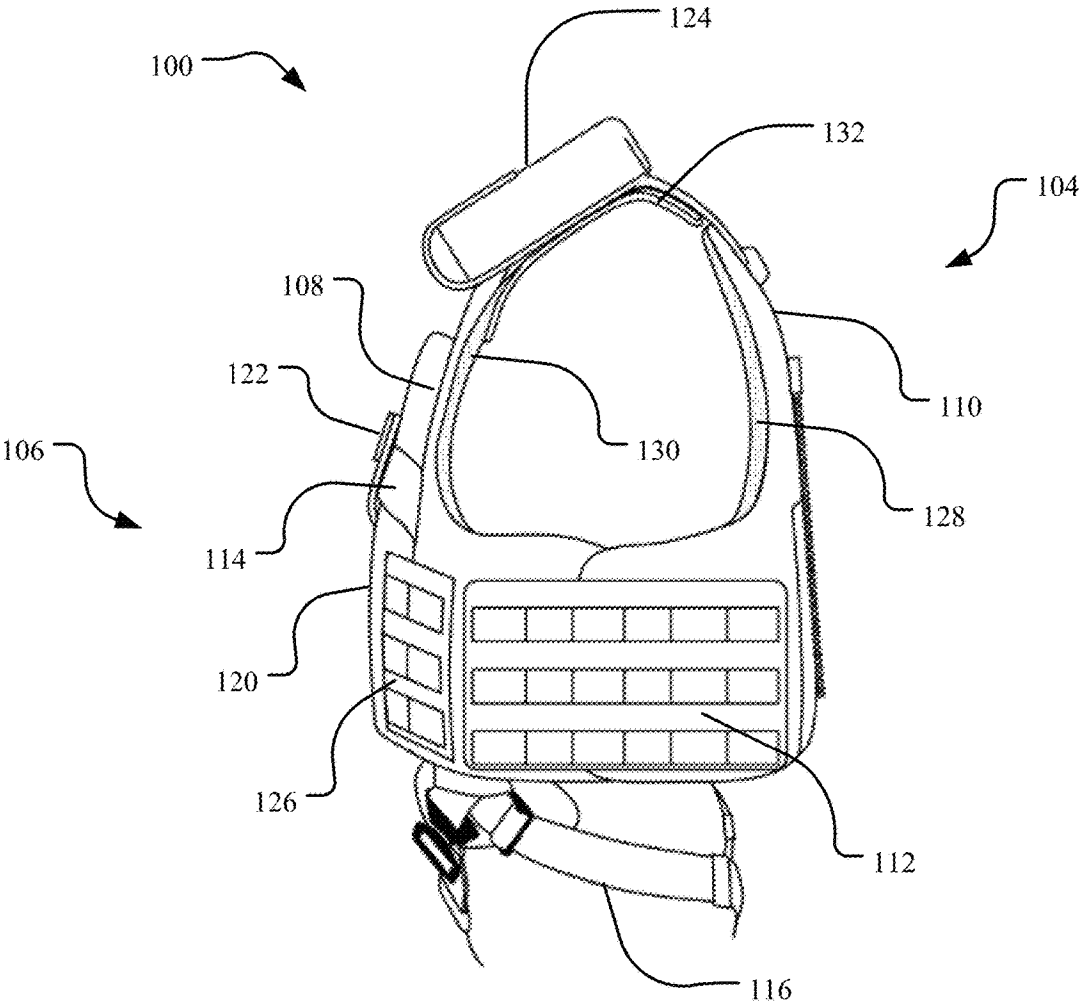
FIG. 2 is another side perspective view of the integrated body armor harness system.

In one implementation, a shackle pocket 122 is disposed relative to the shackle harness 114 for storing the shackle 118. For example, the shackle pocket 122 may be disposed at a proximal end of the front pocket 120. The shackle pocket 122 may include a flap with a tab facilitating quick access to the shackle 118. As such, the shackle 118 may be stored, as illustrated in FIG. 2, so as not to inhibit movement by the individual 102 until it is needed for extraction. At that time, the individual 102 can quickly access the shackle 118 via the flap of the shackle pocket 122.

The tactical vest 104 may further include other attachment points to hold mission specific equipment, such as pouches 124, platforms, ammunition, weapons, communication devices, restraints, signaling equipment, medical equipment, and other tactical, rescue, or similar equipment, as needed. The attachment points may include, without limitation, pockets, tabs, rows of webbing, and/or the like. The rows of webbing may be disposed on the front panel 108, the back panel 110, the cummerbunds, the front pocket 120, and/or other locations on the tactical vest 104. The rows of webbing may be Modular Lightweight Load-carrying equipment (MOLLE) webbing adapted to carry mission specific equipment that may be interchanged based on the needs of the mission. In one implementation, the rows of webbing may be Pouch Attachment Ladder System (PALS) webbing adapted to attach mission specific equipment onto the load-bearing platform of the various portions of the tactical vest 104. The rows of webbing may be made from a variety of materials having superior strength and resistance to cutting and abrasion, such as nylon. The attachment points may be disposed around the integrated body armor harness system 100 according to the anatomy of the individual 102 and/or the needs of the mission.

The integrated body armor harness system 100 may be converted into a stand-alone extraction harness, an air crew specific system, a pilot specific system, or other systems specifically configured for a mission type and/or an individual type. For example, all or at least a portion of the tactical vest 104 may be removable to convert the integrated body armor harness system 100 based on the mission type. In one implementation, the front panel 108, the back panel 110, and/or the cummerbunds 112 are removable, as needed. The integrated body armor harness system 100 may include a front mesh 130 and a back mesh 128, which may be integrated with or separate from the front panel 108 and the back panel 110, respectively. The integrated body armor harness system 100 may further include should pads 132. In one implementation, the front mesh 130, the back mesh 128, and/or the shoulder pads 132 are integrated with the extraction harness 106, such that they remain when the front panel 108 and/or the back panel 110 are removed.

In addition to various portions of the tactical vest 104 being removable, various portions of the extraction harness 106 may be removable. For example, portions of the extraction harness 106 may be connected via one or more releasable connection points, such as buckles, shackles, and/or other releasable connection points capable of handling the load of the individual 102, the integrated body armor harness system 100, and any additional load during extraction. The integrated body armor harness system 100 may include various flaps, such as the side flaps 126, and pads to conceal and protect the releasable connection points and/or provide comfort to the individual 102.

The integrated body armor harness system 100 may be configured to accommodate a specific individual type. For example, where the individual 102 is female, the tactical vest 104 may be adapted for the natural shape of a female wearer, while providing a full range of motion and support and eliminating excess compression on the breast tissue. Similarly, where the individual 102 is male, the tactical vest 104 may be adapted to comport with the male anatomy to provide a full range of motion. Similar accommodations may be made with the extraction harness 106, for example, with respect to load points and a distribution of the load during extraction relative to the anatomy of the individual 102.

Generally, the integrated body armor harness system 100 is a lightweight and low bulk system for wearing or otherwise carrying mission specific equipment that provides survival capabilities against mission specific threats, such as battlefield threats, induced or naturally occurring environmental threats, and/or the like. Stated differently, the integrated body armor harness system 100 is a survival gear carriage system for mounting on the individual with integrated extraction capability. The integrated body armor harness system 100 includes aircraft internal and external restraint devices and facilitates the storage and/or carrying of mission specific equipment. In some implementations, the integrated body armor harness system 100 may further provide floatation capabilities for use in missions involving or otherwise traveling over bodies of water. For example, the integrated body armor harness system 100 may have attachment points for mounting a floatation collar or other over water gear. The integrated body armor harness system 100 includes integrated body armor, which may include the tactical vest 104, to provide torso, extremity, and/or other body protection for the individual 102.

As such, the integrated body armor harness system 100 may be worn by the individual 102 when conducting aviation missions, whether the individual 102 is acting as the pilot or performing cabin crew activities. With the integrated body armor harness system 100 being lightweight and low bulk, the individual 102 may wear the integrated body armor harness system 100 during missions having an extended duration (e.g., approximately twelve hours), including those involving extended time in continuous mission oriented protective posture. The integrated body armor harness system 100 is further capable of withstanding a high static load (e.g., approximately 2700 lbf or more) and a high dynamic load (e.g., approximately 2700 lbf or more) applied to the shackle harness 114. Overall, the integrated body armor harness system 100 may be used for equipment carriage, extraction, retrieval, restraint, and/or other activities.

Figure 3:
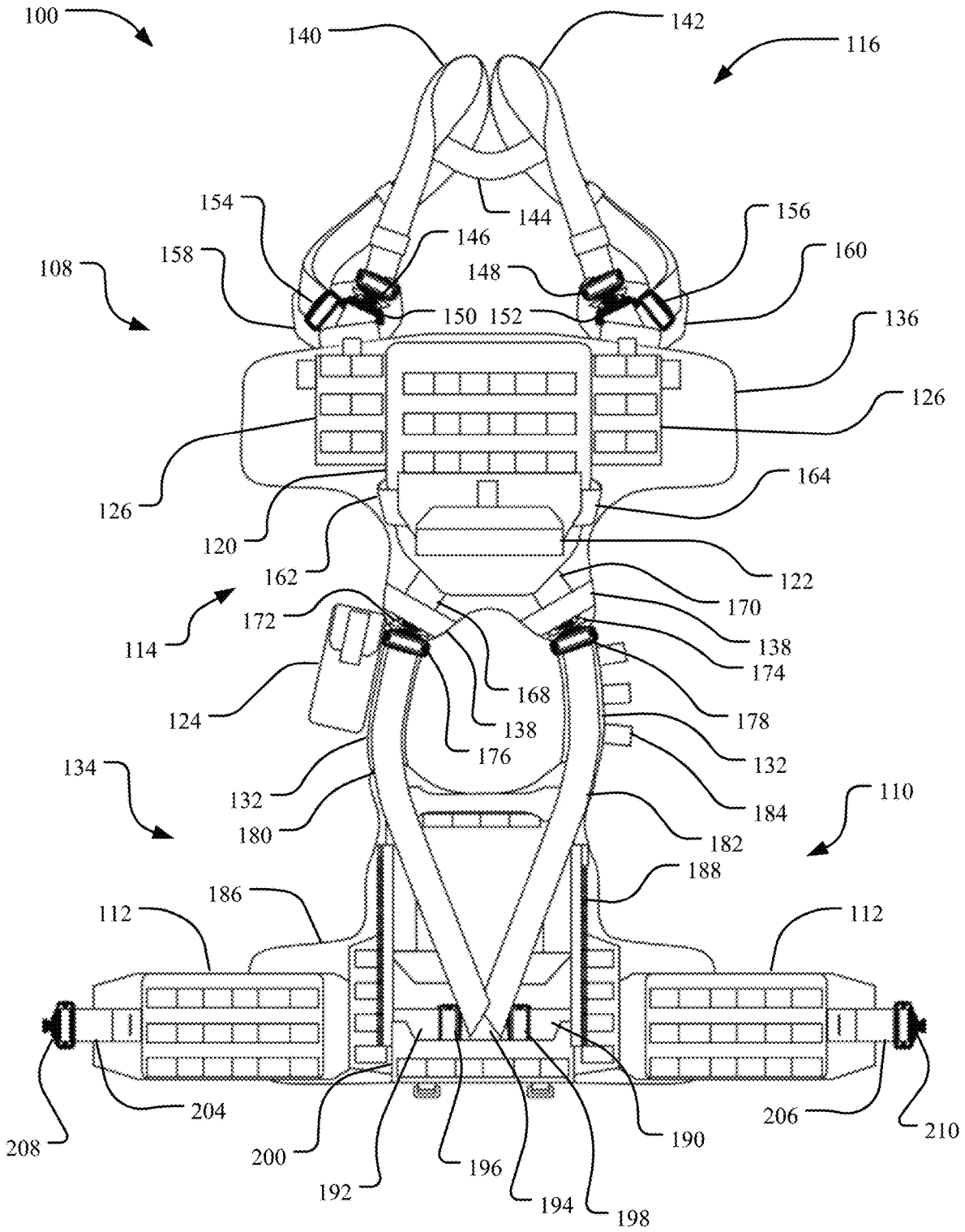
FIG. 3 is a top plan view of the integrated body armor harness system laid flat with a back cover removed.

Turning to FIG. 3, which shows the integrated body armor harness system 100 laid flat, it will be understood that, in one implementation, the extraction harness 106 includes the shackle harness 114, the leg harness 116, and a torso harness 134 integrated with the tactical vest 104. The shackle harness 114 may be integrated with the front panel 108, and the torso harness 134 may be integrated with the back panel 110, with the leg harness 116 extending distally from a distal end of the tactical vest 104, for example, from a distal end of the front panel 108. In one implementation, the front panel 108 includes an upper portion having a set of arms and a lower portion with a set of side portions 136. The torso harness 134 may connect to the front panel 108 at the set of arms and the side portions, with a set of arm straps 138 covering the connection points at the arms and the side flaps 126 covering the connection points at the side portions 136. It will be appreciated, however, that the shackle harness, the torso harness 134, and the leg harness 116 may be integrated with the tactical vest 104 in other manners.

In one implementation, the leg harness 116 includes a first set of leg straps and a second set of leg straps, which may be connected to each other by a rear leg strap 144. The first set of leg straps and the second set of leg straps may each include one or more leg straps extending from the front panel 108. In one implementation, the first set of leg straps includes a first leg strap 140 connected to the front panel 108 at a first connection point and a second connection point. Similarly, the second set of leg straps includes a second leg strap 142 connected to the front panel 108 at a third connection point and a fourth connection point.

One or more of the connection points may be releasable. For example, the first connection point for the first leg strap 140 may be a releasable buckle having a first buckle portion 146 and a second buckle portion 150, and the third connection point of the second leg strap 142 may be a buckle having a first buckle portion 148 and a second buckle portion 152. Other connection points may be configured to permit adjustment of a length of the straps. For example, the second connection point of the first leg strap 140 may include a fixed buckle 154 through which the first leg strap 140 may be looped. After passing through the loop of the fixed buckle 154, the first leg strap 140 may be releasably fixed to itself with one or more securing loops. The individual 102 may pull the end of the first leg strap 140 to adjust the length and therefore the fit of the first leg strap 140 and secure it using the one or more securing loops. Alternatively or additionally, the first leg strap 140 may loop through the fixed buckle 154 and be fixed to itself, with the first leg strap 140 being adjustable via the first buckle portion 146. More particularly, the first buckle portion 146 may include an opening through which the first leg strap 140 loops to be releasably fixed to itself using one or more securing loops. Thus, the first leg loop 140 may include one or more fixed end portions and/or one or more adjustable end portions.

The adjustable end portions may be formed from a portion of the first leg strap 140 looping through the first buckle portion 146 or the fixed buckle 154. As such, a portion of the inner surface of the first buckle portion 140 becomes an outer surface of the adjustable end portion, and the corresponding portion of the outer surface becomes an inner surface of the adjustable end portion. In one implementation, the inner surface of the adjustable end portion includes an adjustable end attachment surface configured to releasably engage a corresponding attachment surface disposed on the outer surface of the first leg strap 140. The adjustable end attachment surface and the corresponding attachment surface may be paired hook and loop attachment surfaces. The adjustable end portion may further or alternatively end through a securing loop.

In one implementation, the fixed end portion is attached to the first buckle portion 146 or the fixed buckle 154, for example by looping through an opening in the 146 or the fixed buckle 154, and secured to the first leg strap 140. Where the fixed end portion is formed from a portion of the first leg strap 140 looping through an opening, a portion of the inner surface of the first leg strap 140 becomes an outer surface of the fixed end portion, and the corresponding portion of the outer surface becomes an inner surface of the fixed end portion. In one implementation, the inner surface of the fixed end portion is secured to the inner surface of the first leg strap 140, with the outer surface of the fixed end portion facing towards the individual 102. The fixed end portion may be stitched to the first leg strap 140 and/or secured with one or more securing loops. The securing loop(s) may be looped around and sewn or otherwise attached to the fixed end portion and the first leg strap 140. It will be appreciated the third connection point and the fourth connection point of the second leg strap 142 may be similar to the first connection point and the second connection point of the first leg strap 140, respectively, with the third connection point including the first buckle portion 148 and the second buckle portion 152 and the fourth connection point including a fixed buckle 156. The first and second buckle portions 148 and 152 of the second leg strap 142 may be similar to the first and second buckle portions 146 and 150 of the first leg strap 140, and the fixed buckle 156 may be similar to the fixed buckle 154.

In one implementation, the connection points of the leg harness 116 are padded for comfort of the individual 102. For example, a first leg pad 158 may extend distally from the lower portion of the front panel 108 relative to the connection point(s) of the first leg strap 140, and a second leg pad 160 may extend distally from the lower portion of the front panel 108 relative to the connection point(s) of the second leg strap 142.

As discussed herein, in one implementation, the shackle harness 114 is integrated with the front panel 108 with at least one shackle strap extending from the front panel 108 to receive the shackle 118. In one implementation, the at least one shackle strap includes a first shackle strap 162 and a second shackle strap 164. The first shackle strap 162 may extend from the front panel 108 on a first side of the front pocket 120 with the second shackle strap 164 extending from the front panel 108 on a second side of the front pocket 120 opposite the first side. The shackle pocket 122 may be oriented relative to the first and second shackle straps 162 and 164 to facilitate storage of the shackle 118, as shown in FIG. 3.

The shackle harness 114 may further include a set of arm straps oriented relative to the set of arms of the upper portion of the front panel 108. For example, a first arm strap 168 and a second arm strap 170 may each extend from the front panel 108 along one of the arms and under one of the arm straps 138 where it engages with the torso harness 134 at a releasable connection point. In one implementation, a first shoulder strap 180 of the torso harness 134 includes a first buckle portion 176, and the first arm strap 168 includes a second buckle portion 172 configured to releasably engage the first buckle portion 176. Similarly, a second shoulder strap 182 of the torso harness 134 includes a first buckle portion 178, and the second arm strap 170 includes a second buckle portion 174 configured to releasably engage the first buckle portion 178. In one implementation, the shoulder pads 132 are disposed under each of the first shoulder strap 180 and the second shoulder strap 182 for comfort of the individual 102. Further, the shoulder pads 132 may each include one or more tabs 184 for engaging mission specific equipment for carrying. For example, the tabs 184 may include a strip of paired hook and loop fasteners configured to engage a corresponding strip on the equipment, such as the pouch 124.

In one implementation, the first and second shoulder straps 180 and 182 are integrated with the back panel 110. For example, the back panel 110 may include a back pocket having a first opening through which the first shoulder strap 180 extends into and a second opening through which the second shoulder strap 182 extends into. The back pocket may include a set of zippers 188 for closing the back pocket. In one implementation, the shoulder straps 180 and 182 connect with at least one torso strap near a lower portion of the back panel 110. Similar to the front panel 108, the lower portion may include a set of side portions 186. In one implementation, the at least one torso strap includes a first side torso strap 192, a middle strap 194, and a second side torso strap 190. One or more fixed buckles, such as fixed buckles 196 and 198, may separate the straps 190-194 and permit adjustment of the at least one torso strap. In one implementation, a back flap 200 covers the at least one torso strap and the fixed buckles, as well as provides additional attachment points. In one implementation, a first side strap 204 extends from the first side torso strap 192 through one of the cummerbunds 112, and a second side strap 206 extends from the second side torso strap 190 through one of the cummerbunds 112. It will be appreciated that the straps 190, 192, 194, 204, and 206 may each be a portion of the same torso strap or separate straps connected to each other.

To wear the integrated body armor harness system 100, the individual 102 may insert his or her head between the shoulder straps 180 and 182, positioning the front panel 108 over his or her chest and the back panel 110 over his or her back. The first side strap 204 and the second side strap 206 each engage a corresponding front side strap at a connection point under one of the side flaps 126. For example, the first side strap 204 may include a first buckle portion 208, and the second side strap 206 may include a second buckle portion 210, with the first buckle portion 208 and the second buckle portion 210 configured to releasably engage corresponding buckle portions under the side flaps 126.

Figure 4:
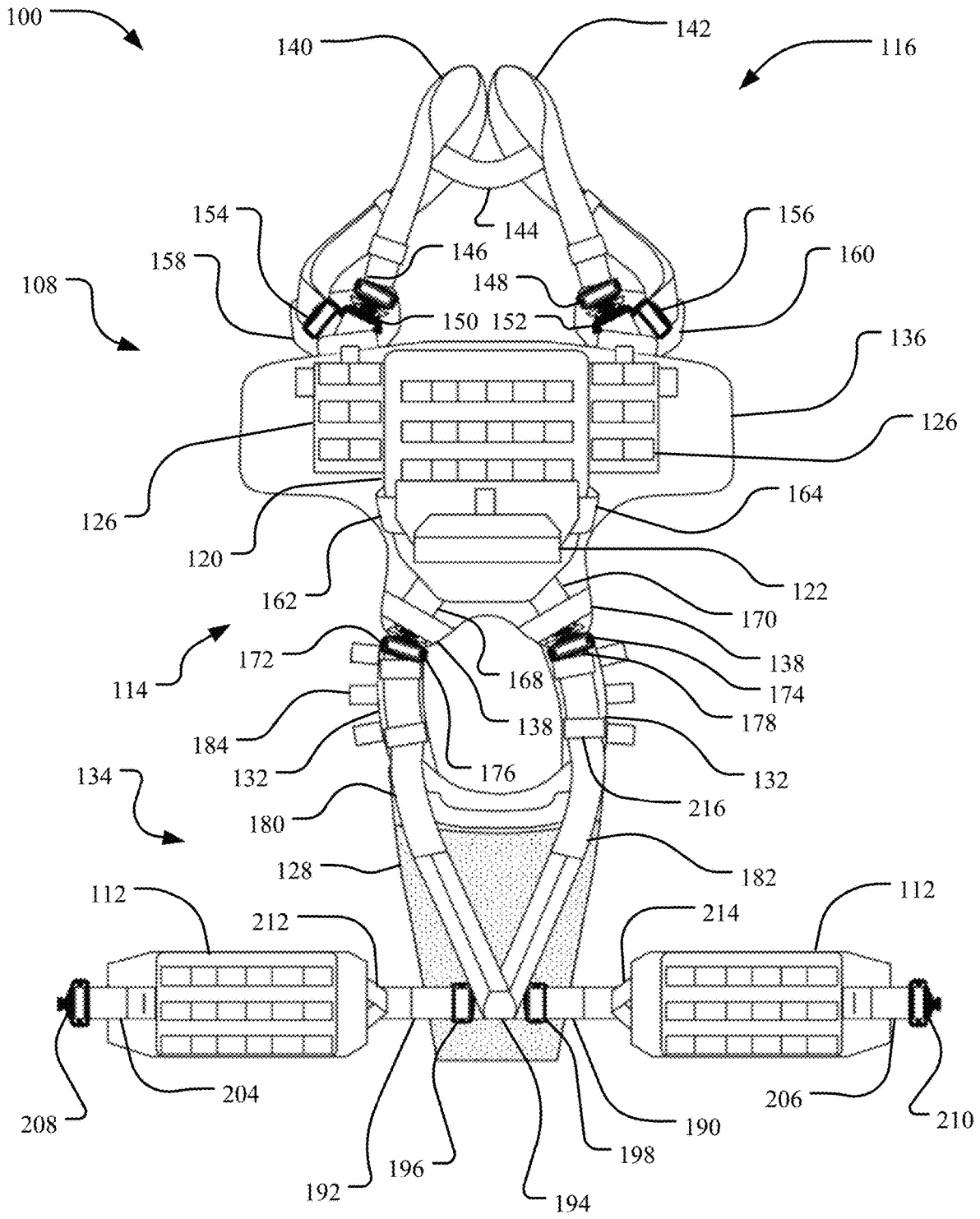
FIG. 4 shows the integrated body armor harness system of FIG. 3 with a back panel removed.

As described herein, the integrated body armor harness system 100 may be converted into other specific systems, for example, by removing the front panel 108, the back panel 110, and/or the cummerbunds 112. In one implementation, the back panel 110 may be removed, as shown in FIG. 4 with the back mesh 128 remaining for comfort. The torso harness 134 may be fixed to the back mesh 128. For example, the shoulder straps 180 and 182 and the middle strap 194 may each be stitched or otherwise fixed to the back mesh 128. The cummerbunds 112 may similarly be fixed to the torso harness 134. In one implementation, a first cummerbund strap 212 and a second cummerbund strap 214 attach one of the cummerbunds 112 to the first side strap 204 and the second side strap 206, respectively. Additionally, the shoulder pads 132 may remain once the back panel 110 is removed. One or more securing loops 216 may attach each of the shoulder straps 180 and 182 to the shoulder pads 132.

Figure 5:
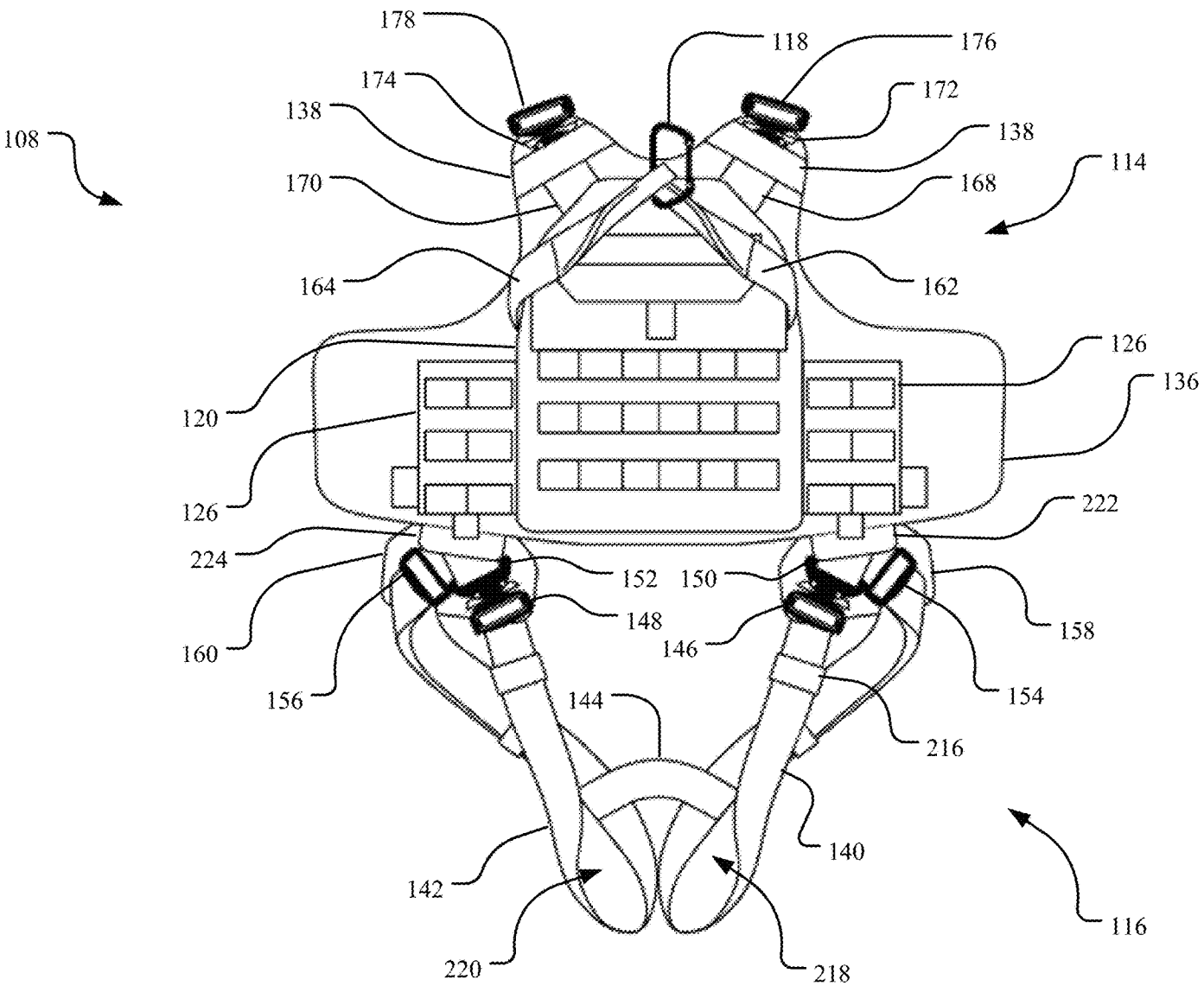
FIG. 5 is a front view of a front panel with an integrated leg harness and shackle harness of the integrated body armor harness system.

Referring to FIG. 5, the leg harness 116 may receive the legs of the individual before the head is inserted between the shoulder straps 180 and 182 or the leg harness 116 may be put onto the legs of the individual after the remainder of the integrated body armor harness system 100 is in place using the releasable connection points. In one implementation, a first leg flap 222 covers the connection points of the first leg strap 140, and a second leg flap 224 covers the connection points of the second leg strap 142. In one implementation, the first leg strap 140 forms a first leg loop 218, and the second leg strap 142 forms a second leg loop 220. The first leg loop 218 receives a first leg of the individual 102, and the second leg loop 220 receives a second leg of the individual 102 with the rear leg strap 144 extending between the first leg strap 140 and the second leg strap 142 across the butt of the individual 102.

Figure 6:
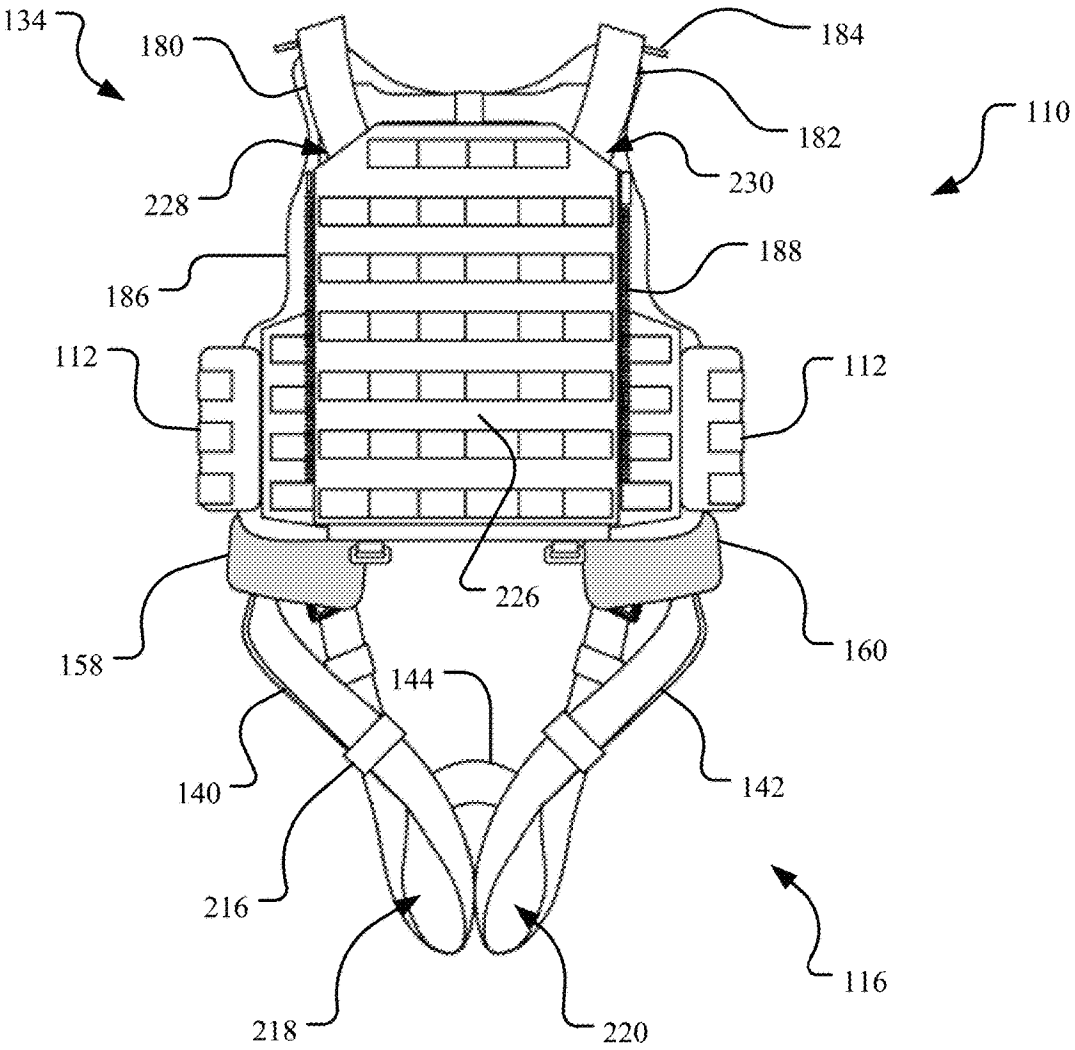
FIG. 6 is a back view of the integrated body armor harness system.
Figure 7:
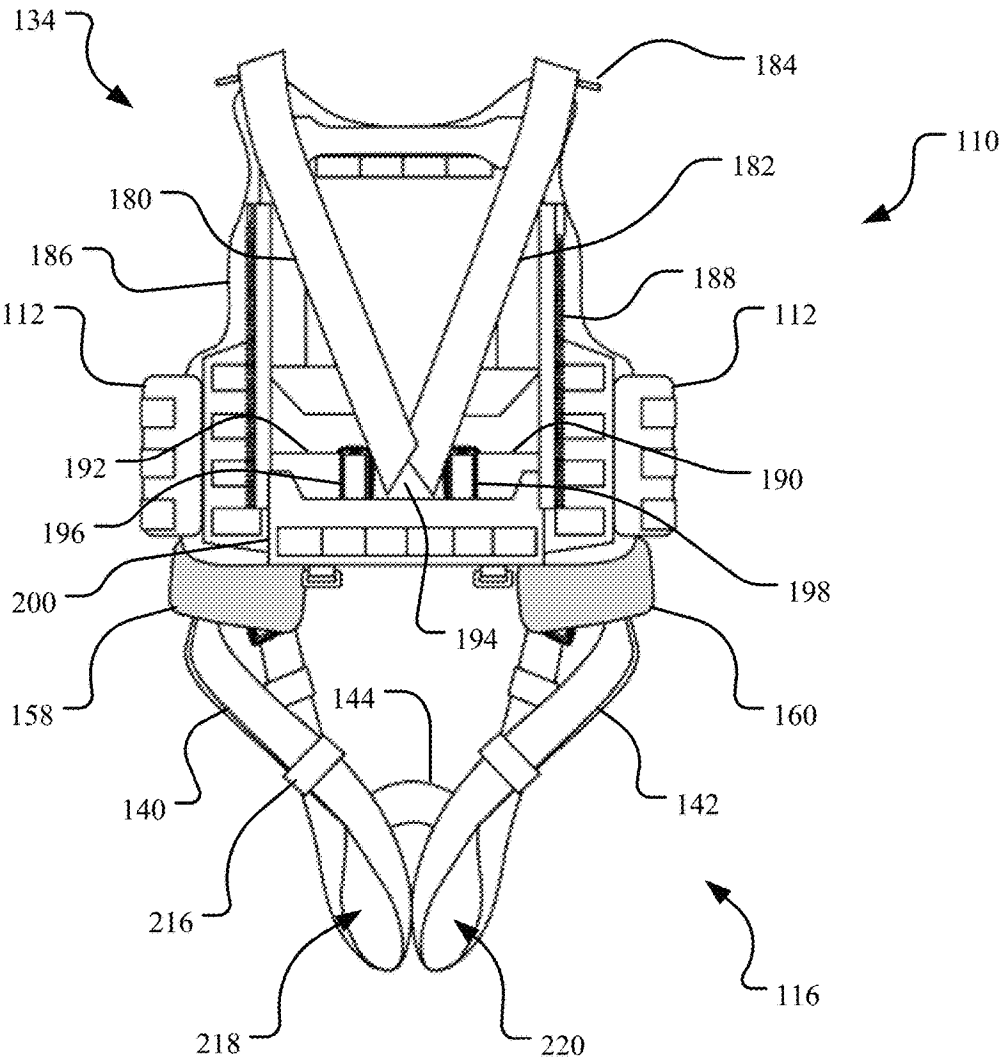
FIG. 7 shows the integrated body armor harness system of FIG. 6 with the back cover removed.
Figure 8:
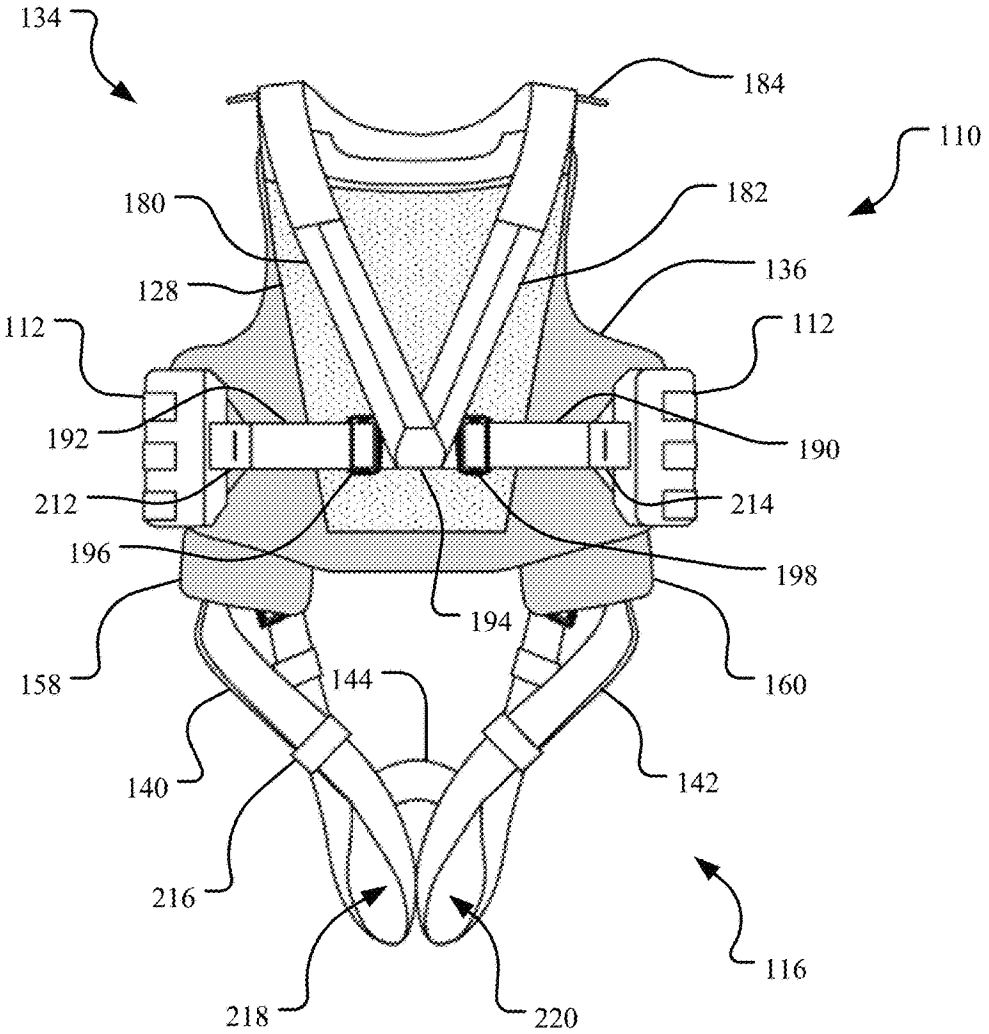
FIG. 8 depicts the integrated body armor harness system of FIG. 6 with the back panel removed.

Turning to FIGS. 6-8, in one implementation, a back cover 226 is releasably engageable to the back panel 110 to form the back pocket. The back cover 226 may be releasably engaged to the back panel 110 using the set of zippers 188, as shown in FIG. 6. In one implementation, a first opening 228 and a second opening 230 are formed between the back cover 226 and the back panel 10 into the back pocket. The first shoulder strap 180 may extend into the back pocket through the first opening 228, and the second shoulder strap 182 may extend into the back pocket through the second opening 230. As shown in FIG. 7, the back cover 226 may be removed, and as shown in FIG. 8, the back panel 110 may be removed.

Figure 9:
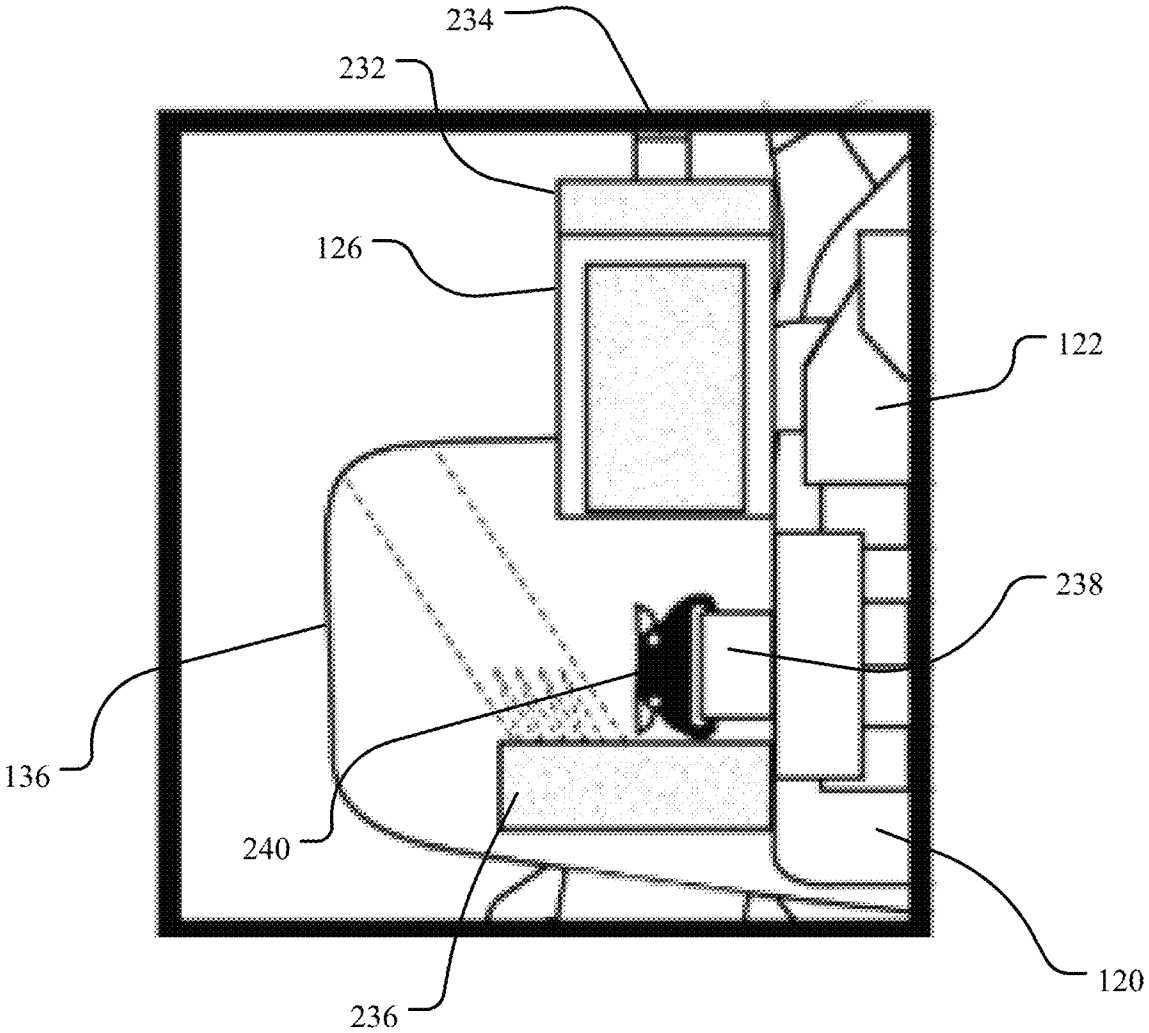
FIG. 9 illustrates a detailed view of a side of the front panel of the integrated body armor harness system with a side flap open showing a front portion of a side buckle of the extraction harness.
Figure 10:
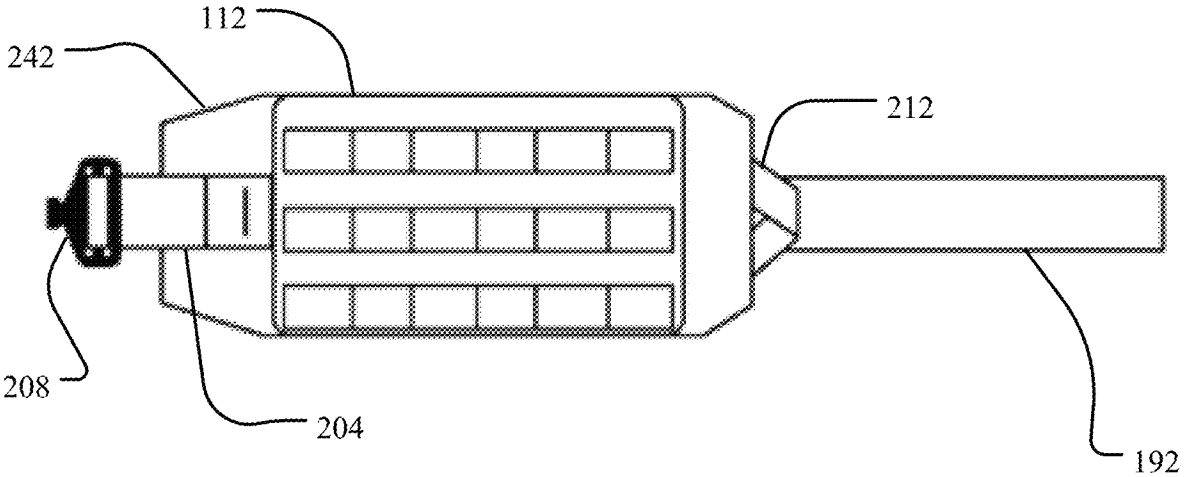
FIG. 10 shows an example cummerbund of the integrated body armor harness system with a back portion of the side buckle.

FIG. 9 provides a detailed view of one of the releasable connection points under one of the side flaps 126. In one implementation, the side flaps 126 each include a strip 232 and a tab 234. The end portion 136 of the front panel 108 may include a corresponding strip 236 configured to engage the strip 232, for example, as paired hook and loop fasteners. The tab 234 permits the individual 102 to quickly access the releasable connection point by disengaging the strip 232 from the strip 236. In one implementation, a front side strap 238 extends from the front pocket 120 and includes a second buckle portion 240 configured to releasably engage the first buckle portion 208 of the first side strap 204, shown in FIG. 10. The side flap 126 may cover the first and second buckle portions 208 and 240, as well as an end 242 of the cummerbund 112. The second side strap 206 may similarly engage a corresponding front side strap 238.

Figure 11:
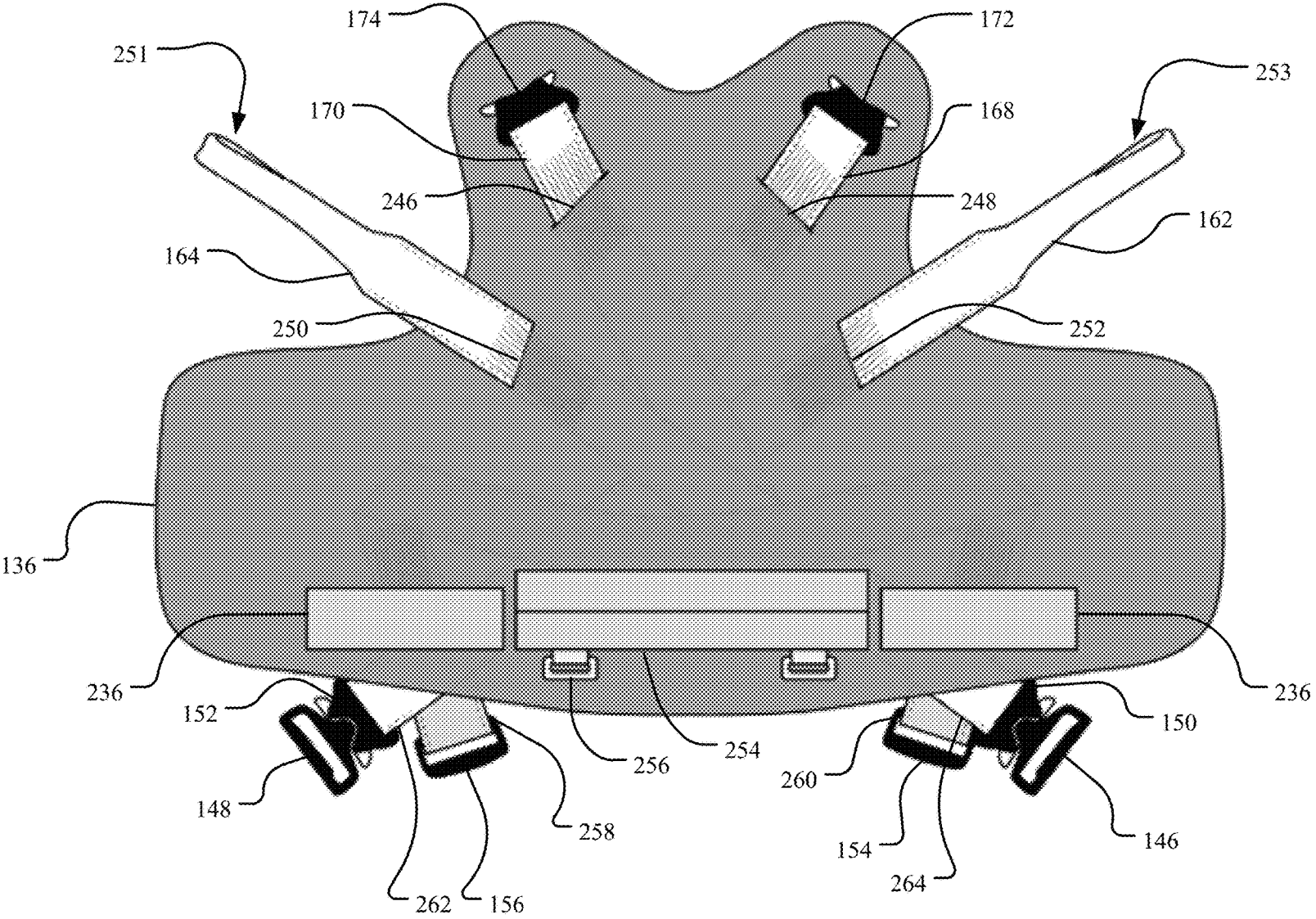
FIG. 11 illustrates a front view of the front panel including the shackle harness with a front pocket and outer layers removed for clarity.
Figure 12:
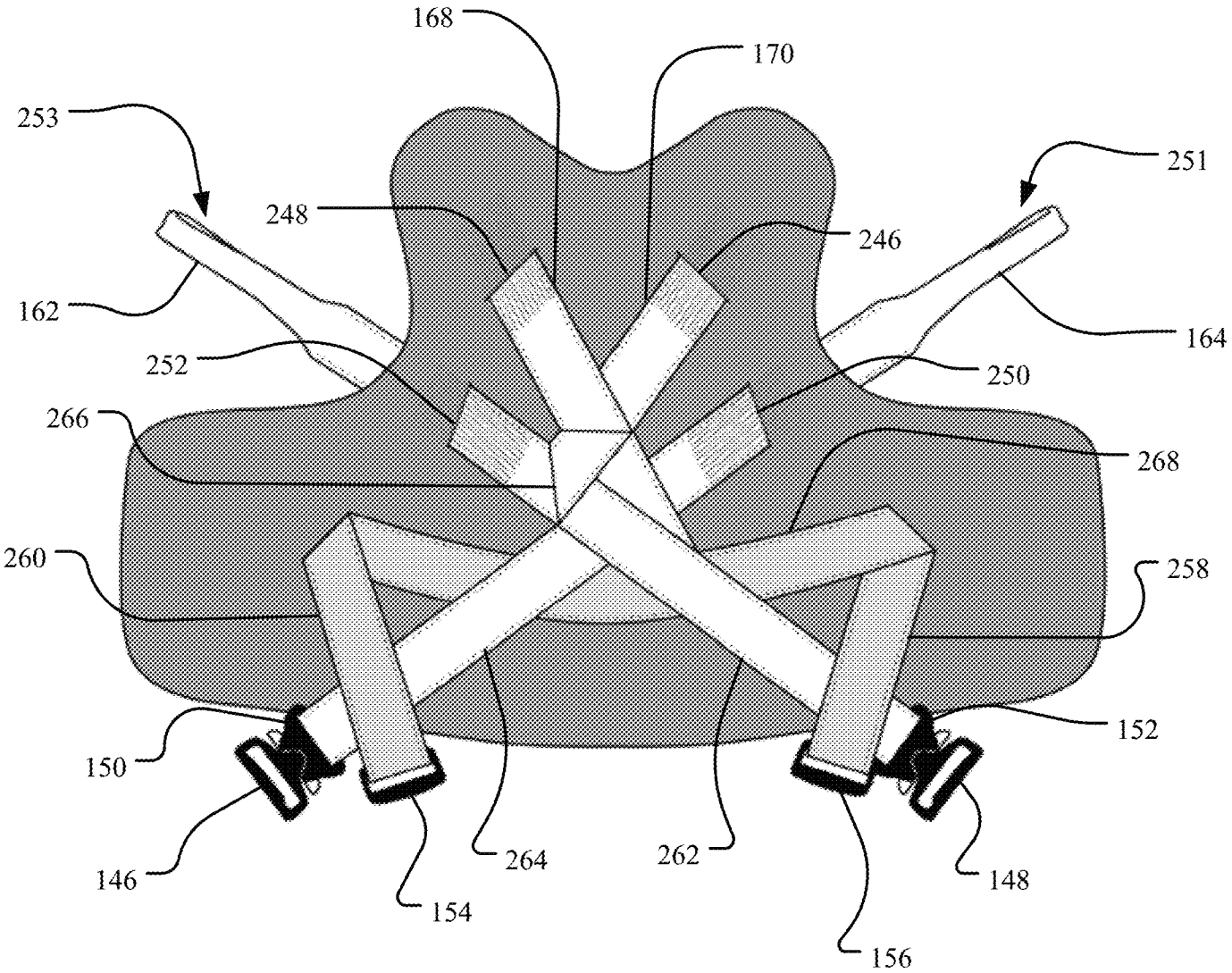
FIG. 12 is a back view of the front panel of FIG. 11.

Turning to FIGS. 11 and 12, in one implementation, the front panel 108 includes one or more openings, including a first arm opening 248, a second arm opening 246, a first shackle opening 252, and a second shackle opening 250. The first arm strap 168 extends through the first arm opening 248, and the second arm strap 170 extends through the second arm opening 246. Similarly, the first shackle strap 162 extends through the first shackle opening 252, and the second shackle strap 164 extends through the second shackle opening 250. As discussed herein, the first shackle strap 162 includes a first shackle loop 253 and the second shackle strap 164 includes a second shackle loop 251. The shackle loops 251 and 253 are adapted to receive the shackle 118. The shackle straps 162 and 164 extend from an outer surface of the front panel 108, such that the shackle loops 251 and 253 are outside the front panel 108. In one implementation, the outside surface may include attachment points, such as an attachment platform 254 having one or more loops 256.

A connection of the various straps in the shackle harness 114 may be disposed behind the inner surface of the front panel 108. In one implementation, the first arm strap 168 intersects with the second arm strap 170 behind the inner surface of the front panel 108. The first arm strap 168 and the second arm strap 170 may each be connected the first shackle strap 162 and/or the second shackle strap 164 with one or more connection straps 266. The first shackle strap 162 may intersect the second shackle strap 164 behind the inner surface of the front panel 108. In one implementation, a first leg connection strap 262 extends from the first shackle strap 162, and a second leg connection strap 264 extends from the second shackle strap 164. The first leg connection strap 262 may be separate from the first shackle strap 162 or a portion of the same strap. Similarly, the second leg connection strap 264 may be separate from the second shackle strap 164 or a portion of the same strap. The first leg connection strap 262 may include the second buckle portion 152, and the second leg connection strap 264 may include the second buckle portion 150. Further, a third leg connection strap 260 and a fourth leg connection strap 258 may extend distally from the front panel 108 and be connected to each other with a middle leg connecting strap 268. The third leg connection strap 260, the fourth leg connection strap 258, and the middle leg connecting strap 268 may be separate straps or portions of the same strap fixed to the inner surface of the front panel 108, as illustrated in FIG. 12. In one implementation, the third leg connection strap 260 includes the fixed buckle 154, and the fourth leg connection strap 258 includes the fixed buckle 156.

While the present disclosure has been described with reference to various implementations, it will be understood that these implementations are illustrative and that the scope of the disclosure is not limited to them. Many variations, modifications, additions, and improvements are possible. More generally, implementations in accordance with the present disclosure have been described in the context of particular examples. Functionality may be separated or combined in blocks differently in various implementations of the disclosure or described with different terminology. These and other variations, modifications, additions, and improvements may fall within the scope of the disclosure as defined in the claims that follow.

What is claimed is:

1. An integrated body armor harness system comprising:

a front panel extending between a proximal end and a distal end;

a shackle pocket operatively coupled to the front panel;

a shackle harness integrated with the front panel, the shackle harness having at least one shackle strap extending from the front panel and having a shackle loop disposed in the shackle pocket;

a shackle removably installable on the shackle loop and sized to bear the load of a user during extraction, the shackle configured to releasably engaging a sling;

a leg harness extending from the distal end of the front panel, the leg harness including a set of leg straps forming a first leg loop and a second leg loop;

a back panel disposed opposite the front panel, the front panel and the back panel forming a tactical vest;

a torso harness integrated with the back panel, the torso harness including a set of shoulder straps and a middle strap operatively coupled the set of shoulder straps; and a first side strap operatively coupled to the middle strap;

a second side strap operatively coupled to the middle strap, the first side strap comprising a first buckle portion and the second side strap comprising a second buckle portion, wherein the first buckle portion and the second buckle portion are configured to couple a portion of the integrated body armor harness to a user.

2. The integrated body armor harness system of claim 1, wherein at least one of the back panel or the front panel is removable.

3. The integrated body armor harness system of claim 1, wherein at least one of the leg harness, the torso harness, or the shackle harness are integral.

4. The integrated body armor harness system of claim 1, wherein a set of cummerbunds extend between the front panel and the back panel; and wherein the first side strap and the second side strap pass through the set of cummerbunds.

5. The integrated body armor harness system of claim 1, wherein the set of leg straps includes a first leg strap associated with the first leg loop connected to a second leg strap associated with the second leg loop with a rear leg strap.

6. The integrated body armor harness system of claim 5, wherein the at least one shackle strap includes a first shackle strap extending through the front panel and connecting with the first leg strap and a second shackle strap extending through the front panel and connecting with the second leg strap.

7. The integrated body armor harness system of claim 6, wherein the first shackle strap and the second shackle strap intersect each other.

8. The integrated body armor harness system of claim 1, wherein the set of shoulder straps connect to at least one torso strap.

* * * * *